US009642398B1

(12) United States Patent
Mason et al.

(10) Patent No.: US 9,642,398 B1
(45) Date of Patent: May 9, 2017

(54) WEARABLE CONNECTOR FOR AN ELECTRONIC TEXTILE

(71) Applicant: TYCO ELECTRONICS CORPORATION, Berwyn, PA (US)

(72) Inventors: Jeffery W. Mason, North Attleboro, MA (US); Wayne S. Alden, III, Whitman, MA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 14/921,618

(22) Filed: Oct. 23, 2015

(51) Int. Cl.
*A41D 1/00* (2006.01)
*H01R 13/73* (2006.01)
*A43B 3/00* (2006.01)

(52) U.S. Cl.
CPC ..... *A41D 1/005* (2013.01); *A43B 3/0005* (2013.01); *H01R 13/73* (2013.01)

(58) Field of Classification Search
CPC ... A41D 1/005; A43B 3/0005; Y10T 24/3683; H01B 1/24
USPC ..... 439/37
See application file for complete search history.

(56) References Cited

U.S. PATENT DOCUMENTS 5,003,673 A * 4/1991 Nysten ..... A44B 17/0005 24/662
5,855,818 A * 1/1999 Gan ..... A43B 7/36 252/503
2004/0244193 A1* 12/2004 Jung ..... H05K 3/363 29/854

* cited by examiner

*Primary Examiner* — Ross Gushi

(57) ABSTRACT

A wearable connector for an electronic textile includes a shell having an upper ring and a lower ring configured to capture the electronic textile therebetween. The shell provides an interior channel at least partially defined by the upper and lower ring. A conductive interface member is received in the interior channel of the shell and is electrically connected to the shell. The conductive interface member has a compressible interface configured to be electrically connected to a conductor of the electronic textile. The conductive interface member is compressed against the conductor by at least one of the upper ring and the lower ring when the lower ring is coupled to the upper ring.

18 Claims, 2 Drawing Sheets

WEARABLE CONNECTOR FOR AN ELECTRONIC TEXTILE

BACKGROUND OF THE INVENTION

The subject matter herein relates generally to wearable connectors for electronic textiles.

Electronic textiles are known and used as wearable technology, such as intelligent clothing or smart clothing, which allows for the incorporation of built-in technological elements in textiles and/or clothes. Electronic textiles may be used in many different applications, including sports training data acquisition, for health monitoring of persons or patients, for first responder (e.g. fire and police) or soldier worn electronics systems, and the like. Electronic textiles are typically fabrics that enable monitoring, computing, digital components and electronics to be embedded in or worn on the textiles. Electronic textiles typically have conductors and electronic devices embedded in or provided on the garments. Some electronic textiles have electronic functions incorporated directly on the textile fibers.

Known electronic textiles are not without disadvantages. For example, attaching or terminating electronic components to the embedded conductors is difficult to accomplish. For example, because the textile material is movable and stretchable, the conductors move and stretch with the material. Reliable electrical connection to such conductors is difficult, particularly with rigid metal contacts. Additionally, because the electronic textiles are wearable, the electronic textiles, from time to time, are cleaned, such as by traditional washing and drying processes. Such washing and drying subject the electrical interconnect between the electronic component and the conductor of the electronic textile to harsh environments, such as water and heat as well as stresses and strains from the spinning action. The electrical connection is degraded over time.

BRIEF SUMMARY OF THE INVENTION

In one embodiment, a wearable connector includes a shell having an upper ring and a lower ring configured to capture an electronic textile therebetween. The shell provides an interior channel at least partially defined by the upper and lower ring. A conductive interface member is received in the interior channel of the shell and is electrically connected to the shell. The conductive interface member has a compressible interface configured to be electrically connected to a conductor of the electronic textile. The conductive interface member is compressed against the conductor by at least one of the upper ring and the lower ring when the lower ring is coupled to the upper ring.

In another embodiment, a wearable connector includes a shell having an upper ring and a lower ring. The lower ring includes a bottom flange and an inner shank. The upper ring includes an annular top flange surrounding a bore. The bore receives the inner shank of the lower ring. The lower ring is coupled to the upper ring such that an electronic textile is captured between the top flange and the bottom flange. The upper ring includes an interior channel bounded by an outer edge of the top flange, a top side of the top flange and the inner shank of the lower ring. The wearable connector includes a conductive interface member received in the interior channel. The conductive interface member includes an annular body surrounding a bore. The inner shank passes through the bore of the conductive interface member. The conductive interface member has a compressible interface configured to be electrically connected to a conductor of the electronic textile. The conductive interface member is compressed against the conductor between the top flange and the electronic textile when the lower ring is coupled to the upper ring.

In a further embodiment, a wearable electronic assembly includes an electronic textile having textile material and a conductor interspersed with the textile material. An electronic component is mounted to the electronic textile. A wearable connector electrically connects the conductor and the electronic connector. The wearable connector includes a shell electrically connected to the electronic component. The shell includes an upper ring and a lower ring configured to capture the electronic textile therebetween. The shell includes an interior channel surrounded by the upper and lower ring. The wearable connector includes a conductive interface member received in the interior channel. The conductive interface member has a compressible interface electrically connected to the conductor of the electronic textile. The conductive interface member is compressed against the conductor by at least one of the upper ring and the lower ring when the lower ring is coupled to the upper ring. The conductive interface member is directly electrically connected to at least one of the upper ring and the lower ring.

DETAILED DESCRIPTION OF SPECIFIC EMBODIMENTS OF THE INVENTION

Figure 1:
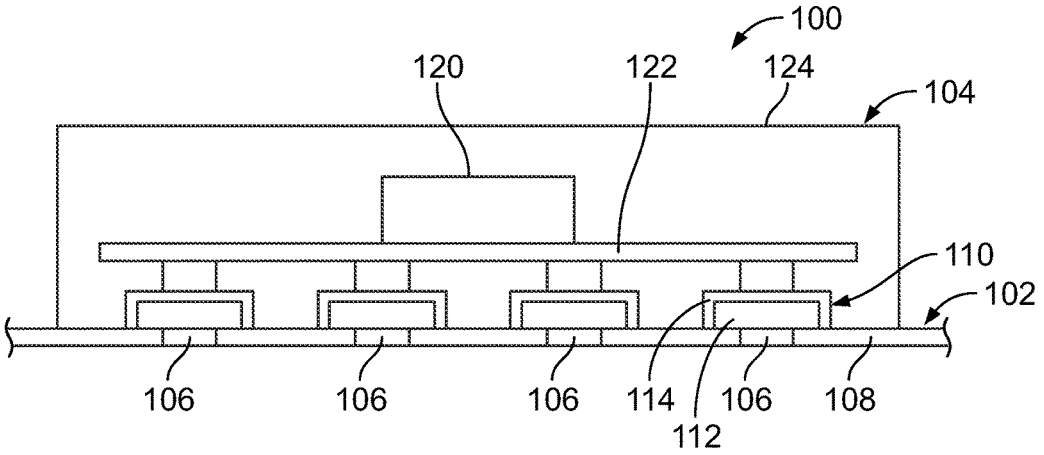
FIG. 1 is a schematic illustration of a wearable electronic assembly having one or more wearable connectors formed in accordance with an exemplary embodiment.

FIG. 1 is a schematic illustration of a wearable electronic assembly 100 formed in accordance with an exemplary embodiment. The wearable electronic assembly 100 includes an electronic textile 102 and an electronic component 104 mounted to the electronic textile 102. The electronic textile 102 may define a garment, clothing, a shoe, a band, or other wearable technology.

The electronic textile 102 includes one or more conductors 106 interspersed with textile material 108 of the electronic textile 102. The conductors 106 are integrated with the textile material 108 such that the electronic textile 102 is a unitary, wearable textile as opposed to the textile having loose wires hanging and routed around the textile material 108. For example, the conductors 106 may be flexible circuits or copper threads woven with the textile material 108. Alternatively, the conductors 106 may be printed on the textile material 108. Other types of conductors 106 may be provided within the electronic textile 102.

The conductors 106 may be used as passive electronics, such as conductors or resistors, for data acquisition from the wearer. For example, the wearable electronic assembly 100 may be used for sports training data acquisition or for health monitoring of the wearer. The conductors 106 may be used to monitor vital signs of the wearer such as heart rate, respiration rate, temperature, activity, posture, or other vital signs. The data gathered by monitoring the wearer's vital signs by the conductors 106 may be transmitted to the electronic component 104, such as for further processing, analysis, or transmission to another system. The conductors 106 may be routed to various locations on the electronic textile 102. For example, for monitoring the wearer's vital signs, the conductors 106 may be routed to various locations around the wearer's chest or to other areas where vital signs are monitored.

In other embodiments, the conductors 106 may define active components, such as transistors, diodes, solar cells, or other types of components, which may be electrically connected to the electronic component 104. In other various embodiments, the conductors 106 may be used to connect the electronic component 104 with other electronic components, such as sensors, displays, light emitting diodes, fiber networks, or other computing devices which may be worn by the wearer or carried by the wearer, such as on the electronic textile 102 or in another component, such as a backpack.

Optionally, the conductors 106 may be embedded within the textile material 108. The conductors 106 may be provided on and exposed on one or more surfaces of the textile material 108. For example, when woven with the textile material 108, the conductors 106 may be provided on both top and bottom surfaces of the textile material 108 as the conductors 106 are weaved with the textile material 108. The conductors 106 may be printed on the top surface, the bottom surface, and/or on other layers of the textile material 108.

The conductors 106 are electrically connected to the electronic component 104 by wearable connectors 110. Optionally, each conductor 106 may be electrically connected to the electronic component 104 by a corresponding wearable connector 110. Alternatively, the wearable connectors 110 may be electrically connected to multiple conductors 106 such that multiple conductors 106 are connected to the electronic component 104 through the same wearable connector 110. In other various embodiments, the conductors 106 are electrically connected to different electronic components 104 by corresponding wearable connectors 110. In the illustrated embodiment, a single electronic component 104 is provided and the conductors 106 are routed to a common location or area on the electronic textile 102 such that the wearable connectors 110 may provide a direct connection between the conductors 106 and the electronic component 104.

In an exemplary embodiment, the wearable connectors 110 each include a conductive interface member 112 that provides an electrical interface between the conductors 106 and the electronic component 104. The conductive interface member 112 is compressible to allow or accommodate for some movement of the electronic textile 102 while still maintaining good electrical connection with the conductors 106 as the conductors 106 and the electronic textile 102 are moved, stretched, flexed, compressed, and the like while worn by the wearer. The conductive interface member 112 may maintain the mating interface therebetween to maintain a generally constant contact resistance at the interface, as compared to conventional systems that do not include compressible interfaces and that have high contact resistance between the conductor and the contact, such as when the electronic textile 104 is manipulated and/or stretched. Optionally, in various embodiments, the conductive interface member 112 is a conductive polymer. In other embodiments, the conductive interface member 112 may be metal element, such as a wave washer, a stranded wire element, such as a gold-plated beryllium-copper wire formed into a dense bundle, a deflectable beam structure, and the like.

In an exemplary embodiment, each of the conductors 106 includes a shell 114 surrounding the conductive interface member 112 to protect the conductive interface member 112. For example, the shell 114 may protect the conductive interface member 112 against stresses or strains from wearing the electronic textile 102 and/or from other uses of the electronic textile 102, such as washing, drying, or folding the electronic textile 102 or other uses. The shell 114 at least partially compresses the conductive interface member 112 into electrical contact with the corresponding conductor 106. Optionally, the shell 114 may completely enclose the conductive interface member 112. The shell 114 may be secured to the textile material 108 to maintain the position of the conductive interface member 112 relative to the conductor 106. In an exemplary embodiment, the shell 114 is a ring terminal secured to the textile material 108. Alternatively, the shell 114 may be a snap fastener or other type of device that may be secured to the textile material 108.

In an exemplary embodiment, the electronic component 102 includes a control module 120 electrically connected to the conductors 106. The control module 120 may include a microprocessor that processes data or signals from the conductors 106. The control module 120 may include a memory for storing the data from the conductors 106. The control module 120 may include a communication device, such as a transmitter/receiver for communicating data to or from the electronic component 104. The control module 120 may output data or signals to the conductors 106, which may be transmitted along the conductors 106 to another electronic component. In such embodiments, a battery or other power source may also be provided.

Optionally, the control module 120 may be mounted to a circuit board 122. The circuit board 122, which may be rigid or flexible according to various embodiments, is electrically connected to the wearable connectors 110. For example, the wearable connectors 110 may be soldered to the circuit board 122. Alternatively, the wearable connectors 110 may be electrically connected to the circuit board 122 at separable interfaces, such as using spring beams, pogo pins, or other type of electrical contacts therebetween. Optionally, wires or cables may provide an electrical connection between the circuit board 122 and the wearable connectors 110. In other various embodiments, the circuit board 122 may be eliminated and the wearable connectors 110 may be directly connected to the control module 120 or connected to the control module 120 via wires or cables.

The electronic component 104 includes a housing 124 surrounding the control module 120 and the circuit board 122. The housing 124 may be mounted to the electronic textile 102 using any type of known securing means, such as clips, fasteners, hook and loop fasteners, thread, and the like. Optionally, the housing 124 may be removably mounted to the electronic textile 102 such that the electronic component 104 may be removed from the electronic textile 102, such as for washing the electronic textile 102. Alternatively, the housing 124 may be permanently mounted and sealed to the electronic textile 102. As such, the electronic component 104 is intended to remain on the electronic textile 102 before, during, and after use of the electronic textile 102.

Figure 2:
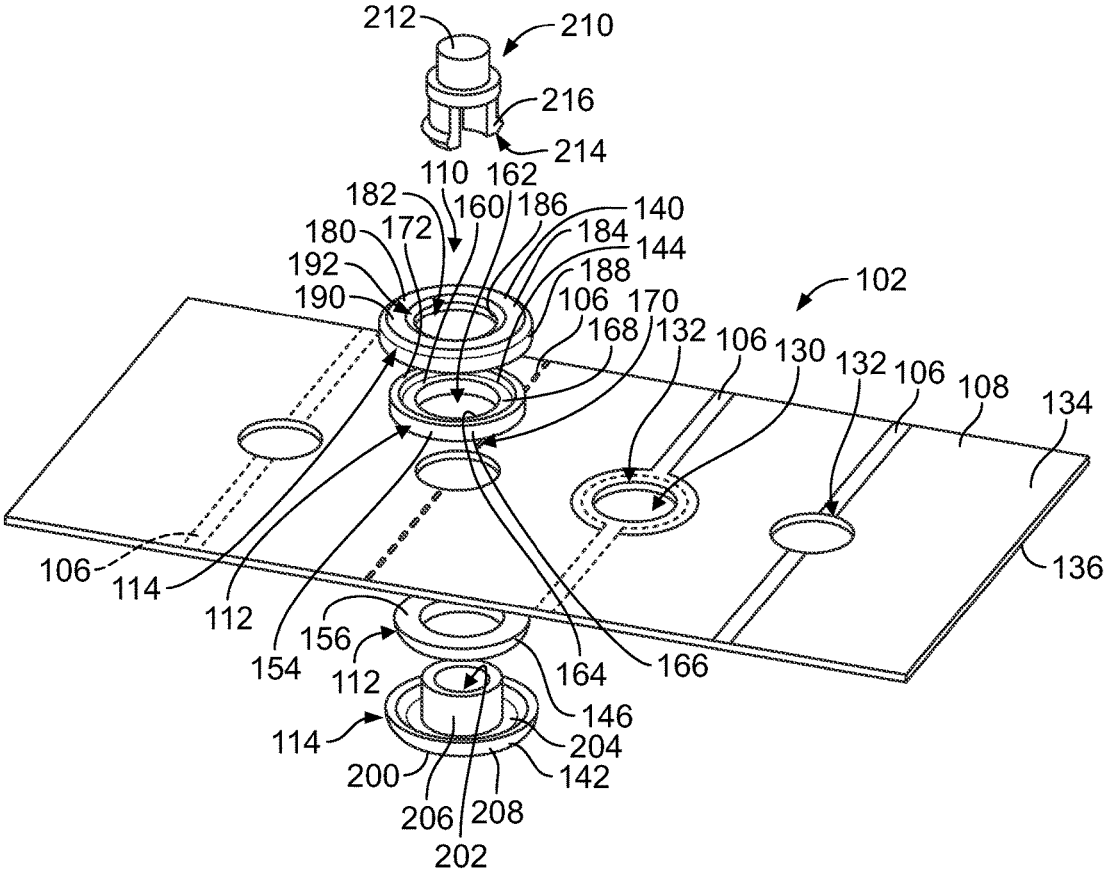
FIG. 2 is an exploded view of a portion of the wearable electronic assembly showing one of the wearable connectors poised for coupling to an electronic textile, according to a specific embodiment.
Figure 3:
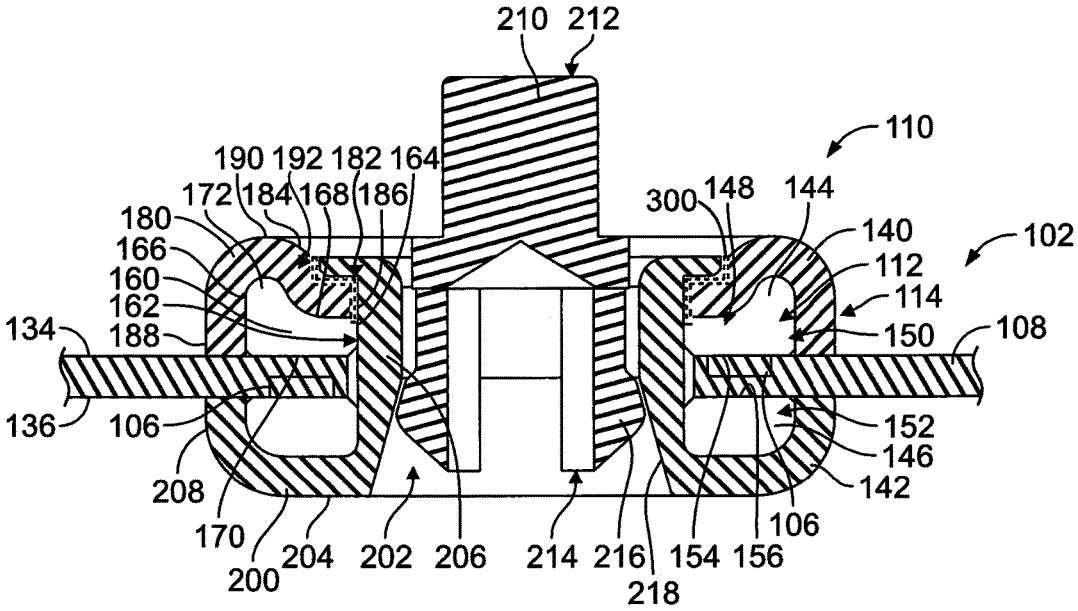
FIG. 3 is a cross-sectional view of a portion of the wearable electronic assembly showing the wearable connector mounted to the electronic textile.

According to a specific embodiment, FIG. 2 is an exploded view of a portion of the wearable electronic assembly 100 showing one of the wearable connectors 110 poised for coupling to the electronic textile 102. FIG. 3 is a cross-sectional view of a portion of the wearable electronic assembly 100 showing the wearable connector 110 mounted to the electronic textile 102. The electronic textile 102 includes an opening 130 in the textile material 108 near the conductor 106. Various forms of the conductor 106 are illustrated in FIG. 2. For example, from left to right, the conductors 106 are illustrated as a printed conductor on the bottom surface, a weaved conductor accessible at both the top and bottom surfaces, a conductor having rings around the opening 130 on both the top and bottom surfaces, and a printed conductor on the top surface. However other variations are possible in alternative embodiments.

Optionally, the conductor 106 may form a pad 132 around the opening 130. The pad 132 is an area for electrical connection of the wearable connector 110 to the conductor 106. The pad 132 may be an area of increased surface area of the conductor 106. For example, the conductor 106 may be wider in the area of the pad 132, may include additional threads in the area of the pad 132, may wrap partially or entirely around the opening 130, or otherwise provide a larger mating interface for the wearable connector 110. Alternatively, the conductor 106 may pass linearly along a side of the opening 130 with the nearest portion of the conductor 106 defining the pad 132 for interfacing to the wearable connector 110.

The wearable connector 110 is mounted to the electronic textile 102 to ensure an electrical connection between the wearable connector 110 and the conductor 106. The wearable connector 110 passes through the opening 130 in the textile material 108 to capture the textile material 108 therein and electrically connects with the conductor 106 on both surfaces 134, 136. In an exemplary embodiment, the wearable connector 110 is provided on both a top surface 134 and a bottom surface 136 of the textile material 108. The wearable connector 110 sandwiches the textile material 108 between the components of the wearable connector 110.

In an exemplary embodiment, the shell 114 includes an upper ring 140 and a lower ring 142. The shell 114 defines an interior channel 148 (FIG. 3), such as between the upper and lower rings 140, 142. The conductive interface member 112 is received in the interior channel 148 and captured between the upper and lower rings 140, 142. In an exemplary embodiment, the conductive interface member 112 is a multi-piece conductive interface member having an upper conductive interface member 144 and a lower conductive interface member 146. Either or both of the conductive interface members 144, 146 may be referred to herein generally as the conductive interface member 112. The upper and lower rings 140, 142 and/or the conductive interface members 144, 146 may be round or circular, as in the illustrated embodiment, or may have other shapes in other various embodiments, such as rectangular, oblong, asymmetrical, and the like.

In an exemplary embodiment, the conductive interface member 112 is a conductive polymer and may be referred to hereinafter as conductive polymer 112 and/or the conductive interface members 144, 146 may be referred to hereinafter as conductive polymers 144, 146. However, as noted above, the conductive interface members 144, 146 may be other types of conductive elements, such as a wave washer, a wire stranded element, such as a gold-plated beryllium-copper wire formed into a dense bundle, a deflectable beam structure, and the like.

The conductive polymers 144, 146 are fabricated from a mixture of a binder material, such as an elastomeric material, and conductive particles, such as silver or other metal particles embedded in the binder material. The conductive polymers 144, 146 provide conductive paths internally between the top and bottom ends. In an exemplary embodiment, the conductive polymers 144, 146 form metalized particle interconnects. The conductive polymers 144, 146 are at least partially compressible. For example, the elastomeric material is compressible. The conductive polymers 144, 146 may be formed in any desired shape and may be formed by molding, such as injection molding. In other various embodiments, rather than having embedded metal particles, the conductive polymers 144, 146 may have a conductive coating on the exterior thereof. For example, the conductive polymers 144, 146 may include a metal plating or coating applied to the surfaces of the conductive polymers 144, 146. The conductive material allows the conductive polymers 144, 146 to be electrically conductive and thus define a signal path from the conductors 106.

In alternative embodiments, as described above, rather than being conductive polymers, the conductive interface members 144, 146 may be metal elements. The metal conductive interface members 144, 146 may be compressible. For example, the metal conductive interface members 144, 146 may have a wavy shape, such as wave washers. The conductive interface members 144, 146 may be helical shaped, such as a helical wave washer or a coil spring. The conductive interface members 144, 146 may have a conical ring or disc shape. Such members may be used in place of the conductive polymers 144, 146 illustrated in the figures.

In other various embodiments, the conductive interface members 144, 146 may be a stranded wire element, a wire wool, a wire sponge, and the like. For example, the stranded wire element may be wound or bunched together to form a dense bundle, which may have any shape, such as a ring shape. The element may be compressible. Such elements may be used in place of the conductive polymers 144, 146 illustrated in the figures.

As seen in FIG. 3, the upper conductive interface member 144 is received in an upper channel 150 defined in the upper ring 140, and the lower conductive interface member 146 is received in a lower channel 152 defined in the lower ring 142. The upper and lower channels 150, 152 together define the common interior channel 148 of the shell 114. When assembled, the shell 114 completely encloses the conductive interface member 112 according to a specific embodiment. For example, the upper ring 140 encloses the upper conductive interface member 144 while the lower ring 142 encloses the lower conductive interface member 146. Optionally, the lower ring 142 may at least partially enclose the upper conductive interface member 144.

During assembly, the lower ring 142 passes through the opening 130 and is coupled to the upper ring 140. For example, the lower ring 142 may be press-formed to the upper ring 140 to capture the conductive interface member 112 and the electronic textile 102 therebetween.

When assembled, the upper conductive interface member 144 is electrically connected to the upper ring 140 and the conductor 106 (when present on the top surface 134). The upper ring 140 compresses the upper conductive interface member 144 against the electronic textile 102 such that the upper conductive interface member 144 is in electrical contact with the conductor 106. In an exemplary embodiment, the upper conductive interface member 144 has a compressible interface 154 configured to be electrically connected to the conductor 106. The upper conductive interface member 144 is compressed against the conductor 106 by the upper ring 140 when the lower ring 142 is coupled to the upper ring 140.

When assembled, the lower conductive interface member 146 is electrically connected to the lower ring 142 and the conductor 106 (when present on the bottom surface 136). The lower ring 142 compresses the lower conductive interface member 146 against the electronic textile 102 such that the lower conductive interface member 146 is in electrical contact with the conductor 106. In an exemplary embodiment, the lower conductive interface member 146 has a compressible interface 156 configured to be electrically connected to the conductor 106. The lower conductive interface member 146 is compressed against the conductor 106 by the lower ring 142 when the lower ring 142 is coupled to the upper ring 140.

In an exemplary embodiment, the upper and lower conductive interface members 144, 146 are ring shaped. The upper conductive interface member 144 is described in further detail below, and the lower conductive interface member 146 may have similar features that may be identified with like reference numerals.

The upper conductive interface member 144 has an annular body 160 and a bore 162 therethrough. The annular body 160 has an inner edge 164 defining the bore 162 and an outer edge 166 generally opposite the inner edge 164. The annular body 160 has an upper end 168 and a lower end 170 generally opposite the upper end 168. The upper and lower ends 168, 170 extend between the inner and outer edges 164, 166. Optionally, the corners between the edges and ends may be rounded. Optionally, the inner and outer edges 164,166 may be oriented vertically. Alternatively, the inner edge 164 and/or the outer edge 166 may be slanted and/or non-parallel to the other edge. The annular body 160 may have a non-uniform width between the inner and outer edges 164, 166. Optionally, the outer edge 166 may be taller while the inner edge 164 may be shorter. Alternatively the inner and outer edges 164, 166 may have approximately equal heights. Optionally, the upper and lower ends 168, 170 may be oriented generally horizontally. Alternatively, the upper end 168 and/or the lower end 170 may be angled non-parallel to the other end.

In the illustrated embodiment, the annular body 160 has a lip 172 at the upper end 168 at or near the outer edge 166. The lip 172 extends circumferentially around the annular body 160. The annular body 160 may have other shapes in alternative embodiments.

In an exemplary embodiment, the upper conductive interface member 144 is compressible and deformable when received in the upper ring 140. For example, the annular body 160 may conform to the shape of the upper channel 150 when the upper and lower rings 140, 142 compress the upper conductive interface member 144. When assembled, the lower end 170 faces the top surface 134 of the electronic textile 102 and the lower end 170 defines the compressible interface 154. The upper ring 140 engages the upper end 168 and presses downward on the upper end 168 to compress the upper conductive interface member 144. When assembled, the inner and outer edges 164, 166 may be captured between the upper and lower rings 140, 142 respectively. As such, the shell 114 engages the inner edge 164, the upper end 168, and the outer edge 166 while the lower end 170 faces and is compressed against the conductor 106 and the textile material 108.

In an exemplary embodiment, the lower conductive interface member 146 is compressible and deformable when received in the lower ring 142. For example, the annular body 160 may conform to the shape of the lower channel 152 when the upper and lower rings 140, 142 compress the lower conductive interface member 146. When assembled, the upper end 168 faces the bottom surface 136 of the electronic textile 102 and the upper end 168 defines the compressible interface 156. The lower ring 142 engages the lower end 170 and presses downward on the lower end 170 to compress the lower conductive interface member 146. When assembled, the inner and outer edges 164, 166 may be enclosed by the lower ring 142. As such, the shell 114 engages the inner edge 164, the lower end 170, and the outer edge 166 while the upper end 168 faces and is compressed against the conductor 106 and the textile material 108.

The upper ring 140 includes a top flange 180 and a bore 182 therethrough. The top flange 180 has a topside 184 extending between an inner edge 186 and an outer edge 188. The upper channel 150 is defined below the top side 184 and interior of the outer edge 188. In an exemplary embodiment, the top side 184 is non-planar and includes a lip 190 at or near the outer edge 188 and a recess 192 interior of the lip 190 at or near the inner edge 186. During assembly, the recess 192 receives a portion of the lower ring 142.

The lower ring 142 includes a bottom flange 200 surrounding a bore 202. The lower ring 142 includes a bottom side 204 at the bottom of the lower ring 142. The bottom side 204 extends between an inner shank 206 and an outer edge 208. The inner shank 206 defines the bore 202 and extends upward from the bottom side 204. The lower channel 152 is defined between the inner shank 206 and the outer edge 208 above the bottom side 204. In an exemplary embodiment, the inner shank 206 is taller than the outer edge 208. The inner shank 206 is configured to extend upward through the opening 130 in the electronic textile 102. The inner shank 206 extends through the bore 162 of the lower conductive interface member 146 and through the bore 162 of the upper conductive interface member 144.

The inner shank 206 extends through the bore 182 of the upper ring 140 and is press-formed to the upper ring 140. For example, the distal end of the inner shank 206 may be received in the recess 192 and pressed against the top side 184 of the upper ring 140. The inner shank 206 may be press-formed by rolling the distal end of the inner shank 206 outward to lock the lower ring 142 to the upper ring 140. The inner shank 206 may be stretch formed, drawn, bulged, bent, coined, flattened, swaged, or otherwise press-formed against the upper ring 140 to couple the lower ring 142 to the upper ring 140.

During assembly, the lower ring 142 is coupled to the upper ring 140, the upper and lower conductive interface members 144, 146 and/or the electronic textile 102 may be compressed between the upper and lower rings 140, 142. The compression of the conductive interface members 144, 146 ensures electrical connection between the conductive interface members 144, 146 and the conductor 106. As the conductive interface members 144, 146 are compressed, the conductive interface members 144, 146 are deformed to fill or substantially fill the upper and lower channels 150, 152. The conductive interface members 144, 146 engage and press against the upper and lower rings 140, 142 to create an electrical connection between the conductive interface members 144, 146 and the rings 140, 142.

In an exemplary embodiment, the interior channel 148 has a channel volume. The conductive interface member 112 has an uncompressed volume larger than the channel volume.

The conductive interface member 112 has a compressed volume smaller than the uncompressed volume. The conductive interface member 112 is compressed from the uncompressed volume to the compressed volume by the shell 114 to substantially fill the channel volume of the interior channel 148. In a similar manner, in an exemplary embodiment, the upper channel 150 has a channel volume. The upper conductive interface member 144 has an uncompressed volume larger than the channel volume of the upper channel 150. The conductive interface member 144 has a compressed volume smaller than the uncompressed volume. The conductive interface member 144 is compressed from the uncompressed volume to the compressed volume by the upper ring 140 to substantially fill the channel volume of the upper channel 150. Similarly, in an exemplary embodiment, the lower channel 152 has a channel volume. The lower conductive interface member 146 has an uncompressed volume larger than the channel volume of the lower channel 152. The conductive interface member 146 has a compressed volume smaller than the uncompressed volume. The conductive interface member 146 is compressed from the uncompressed volume to the compressed volume by the lower ring 142 to substantially fill the channel volume of the lower channel 152.

A signal line for transmitting data signals is formed from the conductor 106 to the shell 114 through the conductive interface member 112. The signal line may pass through the upper conductive interface member 144 and/or through the lower conductive interface member 146. Where the lower ring 142 is press-formed against the upper ring 140, an electrical connection is formed between the lower ring 142 and the upper ring 140 to ensure both rings 140, 142 of the shell 114 are conducting the signal.

Optionally, in alternative embodiments, the wearable connector 110 may define multiple signal lines. For example, the conductive interface member 112 may include a first conductive segment, a second conductive segment and an insulative segment between the first and second conductive segments (for example, alternating conductive and insulative layers stacked vertically). The first conductive segment is electrically connected to one conductor to define a first signal line and the second conductive segment is electrically connected to a different conductor to define a second signal line transmitting different data signals than the first signal line. The conductive interface member 112 may include any number of conductive segments. Optionally, multiple conductive segments (e.g., layers) may be electrically commoned to define a common signal line while other conductive segments define other signal lines. The shell 114 may accommodate the multi-line (or multi-channel) conductive interface member, such as by having various alternating conductive and non-conductive segments. In other various embodiments, the upper conductive interface member 144 may define a first segment of the conductive interface member 112, thus defining a first signal line while the lower conductive interface member 146 may define a second segment of the conductive interface member 112, thus defining a second signal line. The upper and lower shells 140, 142 may be electrically isolated from each other, such as by an insulative layer therebetween. The insulative segment may be provided at the interface between the upper and lower shells 140, 142 represented by the dashed line 300. Other various structures may be provided to allow multiple signal lines to be transmitted by the same wearable connector 110.

When the lower ring 142 is coupled to the upper ring 140, the lower ring 142 is pressed against the bottom surface 136 of the electronic textile 102. For example, the outer edge 208 of the bottom flange 200 presses against the bottom surface 136. As the inner shank 206 is press-formed against the upper ring 140, the upper ring 140 is compressed against the electronic textile 102. For example, the outer edge 188 of the top flange 180 is compressed against the top surface 134 of the electronic textile 102. Thus, the interior channel 148 is closed off by the textile material 108 to ensure that the conductive interface member 112 is contained and enclosed within the interior channel 148.

In an exemplary embodiment, the inner shank 206 defines an interior surface of the interior channel 148 to contain the conductive interface members 144, 146 in the channels 150, 152 respectively. Optionally, the conductive interface member 144 and/or 146 may pass, at least partially, into the opening 130 and/or through the opening 130. For example, the upper conductive interface member 144 may pass into or through the opening 130 into the lower channel 152. The lower conductive interface member 146 may pass into or through the opening 130 into the upper channel 150. Optionally, the upper conductive interface member 144 may engage and be electrically connected to the lower conductive interface member 146. In other alternative embodiments, a single conductive interface member 112 is received in both the upper and lower channels 150, 152. For example, the single conductive interface member 112 may pass through the opening 130 and extend along either or both of the top surface 134 and the bottom surface 136.

In other alternative embodiments, the interior channel 148 may be defined by only the upper channel 150 or only the lower channel 152. For example, the lower ring 142 may extend along the bottom surface 136 without defining a lower channel 152. Alternatively, the upper ring 150 may extend along the top surface 134 without defining the upper channel 150.

In an exemplary embodiment, the wearable connector 110 includes a pin terminal 210 extending from the shell 114. The pin terminal 210 may be a separate component from the shell 114 and received in the bore 202 of the lower ring 142 and/or the bore 182 of the upper ring 140. The pin terminal 210 is electrically connected to the shell 114. The pin terminal 210 includes a mating end 212 for mating with the electronic component 104 (shown in FIG. 1). The pin terminal 210 includes a terminating end 214 terminated to the shell 114. Optionally, the terminating end 214 may be mechanically and electrically connected to the shell 114 by an interference fit. For example, the terminating end 214 may include deflectable terminating fingers 216 configured to be pushed into the bore 202 and held therein by an interference fit. For example, the inner shank 206 may include a beveled section 218 and the terminating fingers 216 may be captured by the beveled section 218. In other alternative embodiments, the terminating end 214 is soldered to the shell 114. In other alternative embodiments, the pin terminal 210 is integral with the shell 114. The pin terminal 210 may be electrically and mechanically connected to the shell 114 by other processes in alternative embodiments.

The mating end 212 is configured for mating with the electronic component 104. Optionally, the mating end 212 may be soldered to the electronic component 104, such as to the circuit board 122 (shown in FIG. 1). In alternative embodiments, the pin terminal 210 may define a separable mating interface for electrical connection to the electronic component 104. For example, the mating end 212 may include a spring beam or a pogo pin for electrical connection to the electronic component 104. Alternatively, the electronic component 104 may include a spring beam or pogo pin for electrical connection to the mating end 212 of the pin terminal 210. In other various embodiments the mating end 212 may be electrically connected by other processes or components such as a wire or cable. For example, the mating end 212 may be crimped or soldered to the end of a wire, with the wire being routed to the electronic component 104. The mating end 212 may be received in a socket or other mating interface of the electric component 104 to establish the electrical connection thereto.

Figure 4:
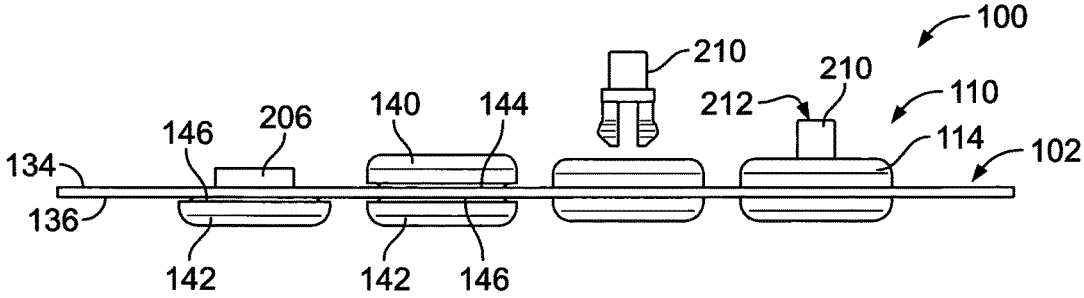
FIG. 4 illustrates the wearable electronic assembly showing a plurality of the wearable connectors in various stages of assembly to the electronic textile.
Figure 5:
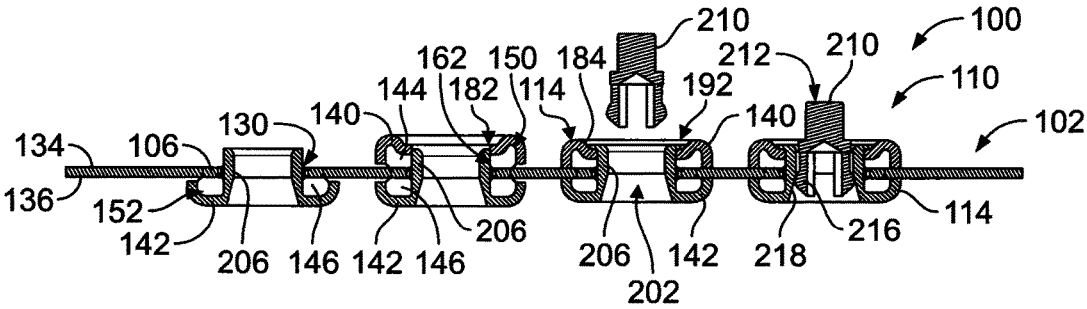
FIG. 5 is a cross-sectional view of a portion of the wearable electronic assembly showing a plurality of the wearable connectors in various stages of assembly to the electronic textile.

FIG. 4 illustrates the wearable electronic assembly 100 showing a plurality of the wearable connectors 110 in various stages of assembly to the electronic textile 102. FIG. 5 is a cross-sectional view of a portion of the wearable electronic assembly 100 showing a plurality of the wearable connectors 110 in various stages of assembly to the electronic textile 102. FIGS. 4 and 5 show an exemplary assembly progression from the left-hand side to the right-hand side.

During assembly, the lower conductive interface member 146 and the lower ring 142 are coupled to the bottom surface 136 of the electronic textile 102. The lower conductive interface member 146 may be received in the lower channel 152. The inner shank 206 is loaded through the opening 130. The lower conductive interface member 146 may engage the conductor 106, when present at the bottom surface 136. The lower conductive interface member 146 may be at least partially compressed by the lower ring 142.

The upper conductive interface member 144 and the upper ring 140 are coupled to the top surface 134 of the electronic textile 102. The upper conductive interface member 144 may engage the conductor 106, when present at the top surface 134. The upper conductive interface member 144 may be received in the upper channel 150. The inner shank 206 is loaded through the bore 162 of the upper conductive interface member 144. The inner shank 206 may be at least partially loaded through the bore 182 of the upper ring 140. The upper conductive interface member 144 may be at least partially compressed by the upper ring 140.

During assembly, the lower ring 142 is coupled to the upper ring 140 to form the shell 114. The lower ring 142 may be press-formed to the upper ring 140 to capture the conductive interface members 144, 146 and the electronic textile 102 therebetween. For example, the distal end of the inner shank 206 may be pressed into the recess 192 and/or pressed against the top side 184 of the upper ring 140. The inner shank 206 may be press-formed by rolling the distal end of the inner shank 206 outward to lock the lower ring 142 to the upper ring 140. The inner shank 206 may be stretched, drawn, bulged, bent, coined, flattened, swaged, or otherwise press-formed against the upper ring 140 to couple the lower ring 142 to the upper ring 140. As the lower ring 142 is pressed to the upper ring 140, the conductive interface members 144, 146 are compressed and forced into the electronic textile 102. Once the shell 114 is formed, the shell 114 entirely surrounds and protects the conductive interface members 144, 146.

The pin terminal 210 may be aligned with the shell 114, such as with the bore 202 in the lower ring 142. The pin terminal 210 is pressed into the bore 202 to make mechanical and electrical contact with the shell 114. The terminating fingers 216 are held in the bore 202, such as by the beveled section 218. The pin terminal 210 may be terminated to the shell 114 by other processes in alternative embodiments or may be integral with the shell 114 in other alternative embodiments. The mating end 212 of the pin terminal 210 is configured for mating with the electronic component 104 (shown in FIG. 1). In other embodiments, the shell 114 may be directly terminated to the electronic component 104 rather than using the pin terminal 210.

A wearable connector is provided that may be easily attached to an electronic textile. The wearable connector includes a conductive interface member that provides a reliable connection to the conductor(s) of the electronic textile. The wearable connector includes a protective shell that provides environmental shielding or protection for the conductive interface member, which may prevent damage to the conductive interface member and/or prolong the useful life of the conductive interface member.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A wearable connector for an electronic textile comprising:

a shell including an upper ring and a lower ring configured to capture the electronic textile therebetween, the shell providing an interior channel at least partially defined by the upper and lower ring;

a terminal extending from and being electrically connected to the shell, the terminal having a mating end for mating with an electrical component; and a conductive interface member received in the interior channel of the shell and being electrically connected to the shell, the conductive interface member having a compressible interface configured to be electrically connected to a conductor of the electronic textile, the conductive interface member being compressed against the conductor by at least one of the upper ring and the lower ring when the lower ring is coupled to the upper ring;

wherein the conductive interface member comprises a first conductive segment, a second conductive segment and an insulative segment between the first and second conductive segments, the first conductive segment being electrically connected to the conductor to define a first signal line, the second conductive segment being electrically connected to a second conductor to define a second signal line transmitting different data signals than the first signal line.

2. The wearable connector of claim 1, wherein the shell substantially encloses the conductive interface member.

3. The wearable connector of claim 1, wherein the lower ring is press-formed to the upper ring to capture the conductive interface member and the electronic textile therebetween.

4. The wearable connector of claim 1, wherein the conductive interface member is ring shaped, a portion of the lower ring passing through the conductive interface member to engage the upper ring.

5. The wearable connector of claim 1, wherein the conductive interface member includes an annular body and a bore therethrough, the annular body having an inner edge defining the bore and an outer edge, the annular body having a lower end and an upper end extending therebetween, one of the lower end or the upper end facing the electronic textile and defining the compressible interface, the shell compressing the other of the lower end or the upper end.

6. The wearable connector of claim 5, wherein the shell engages the inner edge and the outer edge.

7. The wearable connector of claim 1, wherein the upper ring includes a top flange and a bore therethrough, the lower ring includes a bottom flange and an inner shank, the inner shank passing through the electronic textile, the conductive interface member and the bore of the top flange, the top and bottom flanges capturing the electronic textile and conductive interface member therebetween and compressing the conductive interface member against the conductor as the upper and lower rings are coupled together.

8. The wearable connector of claim 1, wherein the conductive interface member is a conductive polymer.

9. The wearable connector of claim 1, wherein the interior channel comprises an upper channel in the upper ring and a lower channel in the lower ring, the conductive interface member defining an upper conductive interface member received in the upper channel configured to engage a top surface of the electronic textile, the wearable connector further comprising a lower conductive interface member received in the lower channel configured to engage a bottom surface of the electronic textile, the upper and lower conductive interface members both being compressed by the upper and lower rings, respectively, when the lower ring is coupled to the upper ring.

10. The wearable connector of claim 1, wherein the interior channel comprises a channel volume, the conductive interface member has an uncompressed volume larger than the channel volume, the conductive interface member has a compressed volume smaller than the uncompressed volume, the conductive interface member being compressed from the uncompressed volume to the compressed volume by the shell to substantially fill the channel volume of the interior channel.

11. The wearable connector of claim 1, wherein the terminal is discrete from the shell and directly engages the shell to electrically connect to the shell.

12. A wearable connector comprising:

a shell including an upper ring and a lower ring, the lower ring comprising a bottom flange and an inner shank, the upper ring comprising an annular top flange surrounding a bore, the bore receives the inner shank of the lower ring, the lower ring is coupled to the upper ring such that an electronic textile is captured between the top flange and the bottom flange, the upper ring includes an interior channel bounded by an outer edge of the top flange, a top side of the top flange and the inner shank of the lower ring;

a terminal extending from and being electrically connected to the shell, the terminal having a mating end for mating with an electrical component; and a conductive interface member having an annular body surrounding a bore, the conductive interface member being received in the interior channel such that the inner shank passes through the bore of the conductive interface member, the conductive interface member having a compressible interface configured to be electrically connected to a conductor of the electronic textile, the conductive interface member being compressed against the conductor between the top flange and the electronic textile when the lower ring is coupled to the upper ring;

wherein the interior channel comprises an upper channel in the upper ring and a lower channel in the lower ring, the conductive interface member defining an upper conductive interface member received in the upper channel configured to engage a top surface of the electronic textile, the wearable connector further comprising a lower conductive interface member received in the lower channel configured to engage a bottom surface of the electronic textile, the upper and lower conductive interface members both being compressed by the upper and lower rings, respectively, when the lower ring is coupled to the upper ring.

13. The wearable connector of claim 12, wherein the annular body of the conductive interface member has an inner edge defining the bore and an outer edge, the annular body having a lower end and an upper end extending therebetween, the lower end facing the electronic textile and defining the compressible interface, the top flange pressing against the upper end to compress the conductive interface member.

14. The wearable connector of claim 13, wherein the inner shank engages the inner edge and the top flange engages the outer edge to substantially encase the conductive interface member.

15. The wearable connector of claim 12, wherein the inner shank passes through the electronic textile, the conductive interface member and the bore of the top flange, the top and bottom flanges capturing the electronic textile and conductive interface member therebetween and compressing the conductive interface member against the conductor as the upper and lower rings are coupled together.

16. The wearable connector of claim 12, wherein the conductive interface member is a conductive polymer.

17. The wearable connector of claim 12, wherein the terminal is discrete from the shell and directly engages the shell to electrically connect to the shell.

18. A wearable electronic assembly comprising:

an electronic textile having textile material and a conductor interspersed with the textile material;

an electronic component mounted to the electronic textile; and a wearable connector electrically connecting the conductor and the electronic component, the wearable connector comprising:

a shell electrically connected to the electronic component, the shell including an upper ring and a lower ring configured to capture the electronic textile therebetween, the shell comprising an interior channel surrounded by the upper and lower ring;

a terminal extending from and being electrically connected to the shell, the terminal having a mating end for mating with the electrical component; and a conductive interface member received in the interior channel, the conductive interface member having a compressible interface electrically connected to the conductor of the electronic textile, the conductive interface member being compressed against the conductor by at least one of the upper ring and the lower ring when the lower ring is coupled to the upper ring, the conductive interface member being directly electrically connected to at least one of the upper ring and the lower ring.

* * * * *